US005478000A

United States Patent [19]

Jensen

[11] Patent Number: 5,478,000

[45] Date of Patent: Dec. 26, 1995

[54] DEVICE FOR AUTOMATICALLY CUTTING AND DISPENSING TAPE

[75] Inventor: Lars D. Jensen, Arlington, Tex.

[73] Assignee: Jensen R&D Corporation, Arlington, Tex.

[21] Appl. No.: 368,084

[22] Filed: Jan. 3, 1995

[51] Int. Cl.[6] ..... A65H 35/07

[52] U.S. Cl. ..... 225/93; 83/337; 225/10; 225/25

[58] Field of Search ..... 225/10, 16, 93, 225/25; 83/337, 647, 949, 592

[56] References Cited

U.S. PATENT DOCUMENTS

| | | | |
|---|---|---|---|
| 1,969,480 | 8/1934 | Shipley | 83/337 |
| 2,274,623 | 2/1942 | Hawkins | 164/68 |
| 2,326,915 | 8/1943 | Anderson | 164/68 |
| 2,326,916 | 8/1943 | Anderson | 164/68 |
| 3,326,917 | 8/1943 | Anderson | 164/49 |
| 3,587,376 | 6/1971 | Hirano | 83/110 |
| 3,690,531 | 9/1972 | Tanigami | 226/136 |
| 3,747,816 | 7/1973 | Se-Kit | 225/11 |
| 3,754,491 | 8/1973 | Tange | 83/277 |
| 3,802,309 | 4/1974 | Bosland | 83/176 |
| 3,968,001 | 7/1976 | Lockwood | 156/523 |
| 4,608,894 | 9/1986 | Lee | 83/322 |
| 4,742,741 | 5/1988 | Hallberg et al. | 83/337 |
| 4,856,397 | 8/1989 | Rebekale | 83/322 |
| 4,953,430 | 9/1990 | Hong | 83/155 |
| 5,048,386 | 9/1991 | DeLuca et al. | 83/337 |
| 5,048,737 | 9/1991 | Sueda | 225/11 |
| 5,237,898 | 8/1993 | Kubisiak | 83/227 |

FOREIGN PATENT DOCUMENTS

| | | |
|---|---|---|
| 4941678 | 4/1974 | Japan . |
| 1061236 | 3/1989 | Japan . |

*Primary Examiner*—Kenneth E. Peterson

[57] ABSTRACT

A tape dispenser holds a stock roll of tape (3) which has adhesive on one or both sides. A section of tape (4) is played out around an idle roller (7), which at times also translates to form a surplus tape loop (16), and around two or more cutter bars (2) mounted in a drum (1) which is powered to turn by a gearmotor (55). The cutter bars can also rotate individually in their bearings (61), and are powered to do so by a cam action inside the drum. When the drum advances, the differential rotation of the cutter bars creates tension in a section of tape, thus tearing it into a segment (5). The length of the tape segment may be preselected by means of an adjustment disk (100).

The object of the invention is to sequentially cut and then present each tape segment to a convenient dispensing position. When a user grasps and lifts the tape segment from the cutter bar, the gearmotor automatically restarts to cut and present a new tape segment.

20 Claims, 19 Drawing Sheets

DEVICE FOR AUTOMATICALLY CUTTING AND DISPENSING TAPE

BACKGROUND OF THE INVENTION

1. Field of the Invention

This invention relates generally to the cutting and dispensing of adhesive tape product, and more particularly to a novel device and method which automatically pre-cuts and presents individual segments of tape for convenient and immediate use.

2. Description of the Prior Art

Heretofore, most automatic tape dispensers have been used in the packaging industry to wet and cut gummed tape. These dispensers are outside the field of the present invention. More recently, industrial dispensers have been developed to automatically dispense adhesive tape, but they are large in size and expensive. Generally, these dispensers automatically feed out new sections of tape, which then must be manually cut against a nearby sharp edge in the traditional way.

U.S. Pat. Nos. 3,690,531, 3,747,816, and 5,048,737 disclose a type of dispenser which has rollers to pull the tape from its roll and feed it outward in a cantilever fashion for access by the user. There is no automatic cutting action. Rather, the user lifts up on the end of the tape, against a fixed serrated cutting edge, cutting the tape conventionally, except that the direction is upward. There is an electric switch which senses the absence of the tape, to automatically restart the motor. By contrast, the present invention does automatically cut the tape before presenting it for use. Furthermore, the present invention re-starts the motor by sensing the action of tape removal, rather than the absence of tape.

Advancing the art by automatically cutting adhesive tape before dispensing it requires overcoming several technical problems. It is difficult to load and manipulate adhesive tape since it adheres to everything it touches. The action of cutting can cause the tape to adhere to the cutter. Mechanisms which cut and advance adhesive tape have heretofore been complicated. A reliable and inexpensive method of sensing the removal of a piece of tape is necessary to initiate automatic action. As distinguishes the present invention, these problems have been solved.

SUMMARY OF THE INVENTION

It is an object of the present invention to provide an automatic adhesive tape dispenser which presents a ready pre-cut segment of adhesive tape for convenient and immediate access by the user. This objective is achieved in three steps:

a) Advancing and pre-cutting the tape, b) Transporting and stopping the tape segment at an optimal dispensing position and, c) Sensing the segment removal, then automatically starting a new cycle.

Accordingly, the tape advancing action utilizes a novel multiple cutter bar design in which the cutter bars are arranged in rotary pattern in a drum, powered to rotate to deploy additional sections of tape. Additionally, the tape cutting action is provided by the controlled rotation of each individual cutter bar by cam action in relation to its rotary drum position. At a position, when simultaneously adhered to two cutter bars, the tape becomes increasingly tense due to a particular difference in rotation between the two cutter bars. The individual rotary position of each of the two cutter bars is particular, such that the tape is adhered to a flat area on an advancing cutter bar and is adhered to a sharp edge on a lagging cutter bar. In this way, the tape is torn and separates from the lagging cutter bar, while the newly-formed segment remains attached to the advancing cutter bar.

Accordingly, the drum continues to rotate, transporting the cutter bar with the attached tape segment until both the drum and cutter bar rotations bring the tape segment to an optimal dispensing position, whereupon the drum automatically stops. Thus, the sequence of cutting and presenting the tape is automatic, and requires only the on and off control of the rotary drum power.

The objective is further achieved by a novel means of sensing the removal of the tape segment. The drum is made to turn freely, so that upward lifting of the tape segment causes an electric switch to restore the drum power. The drum is made to turn freely by two means. First, there is purposely devised a certain limited rotary freedom in the drum power transmission, such that the stationary motor does not restrain drum rotation. Yet, there is no such rotary freedom to that part of the transmission which engages a cam action to the switch. Secondly, there is a loop of excess tape introduced adjacent to the drum by means of a translating idle roller. This loop eliminates drag which would otherwise be imposed on the drum caused by the peeling of the tape from the roll. Therefore, the act of lifting the tape segment turns the drum, which in turn restores the switch to the closed position. This means of sensing tape removal is efficient and economical, since the switch which turns off the motor at the end of a cutting cycle, is the self-same switch utilized to automatically restart the motor.

Yet another object of the present invention is to provide an automatic adhesive tape dispenser for which it is easy to initially load and install a stock roll of tape. This is achieved by the open and simple construction of the invention which does not require the tape to be fed through complicated or restrictive openings. All that is required is to mount the stock roll, pull the tape up over the idle roller, then adhere the end of the tape to any of the cutter bars. Finally, after one or two initial cycles, installation is complete.

Figure 1:
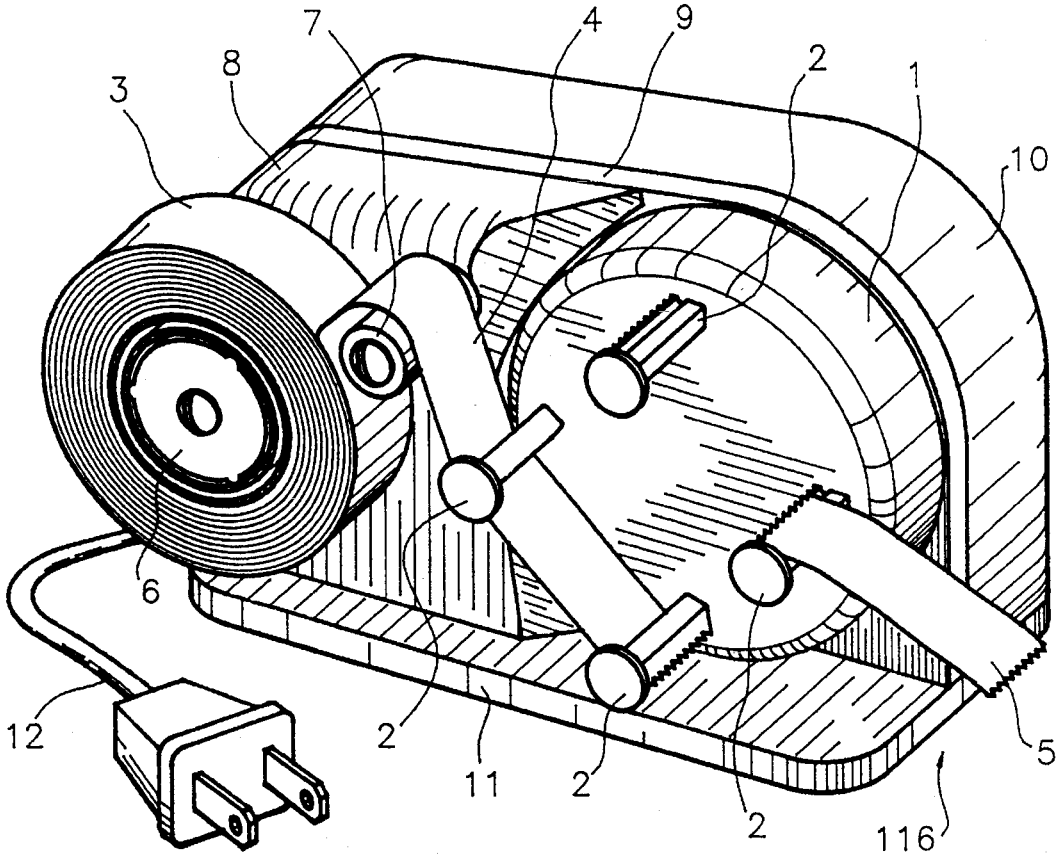
FIG. 1 is a perspective view of the present invention.

| Reference Numerals Used in the Drawings | |
|---|---|
| 1 | drum |
| 2 | cutter bar |
| 3 | roll of tape |
| 4 | section of tape |
| 5 | segment of tape |
| 6 | core holder |
| 7 | idle roller |
| 8 | motor cover |
| 9 | midplate |
| 10 | rear cover |
| 11 | base plate |
| 12 | power cord |
| 13 | lift direction |
| 14 | annular spacer |
| 15 | bearing opening |
| 16 | loop of excess tape |
| 17 | shoulder screw |
| 18 | idle shaft |
| 19 | cutter gear |
| 20 | set screw |
| 21 | cam gear |
| 22 | main shaft |
| 23 | cam path groove |
| 24 | slotted opening |
| 25 | serrated cutting edge |
| 26 | flat |
| 27 | end cap |
| 28 | shaft end |
| 29 | fixed shaft |
| 30 | stub shaft |

-continued

| Reference Numerals Used in the Drawings | |
|---|---|
| 31 | cam roller |
| 32 | ridge |
| 33 | idle cam |
| 34 | lever arm |
| 35 | shoulder pivot screw |
| 36 | follower screw |
| 37 | follower tip |
| 38 | leaf |
| 39 | slotted opening |
| 40 | set screw |
| 41 | large gear |
| 42 | motor gear |
| 43 | slotted opening |
| 44 | cap screw |
| 45 | bushing |
| 46 | cam |
| 47 | set screw |
| 48 | switch |
| 49 | screw |
| 50 | switch plate |
| 51 | washer |
| 52 | screw |
| 53 | slotted opening |
| 54 | set screw |
| 55 | gearmotor |
| 56 | motor shaft |
| 57 | motor plate |
| 58 | spacer |
| 59 | screw |
| 60 | motor rotation direction |
| 61 | bearing hole |
| 62 | lobe |
| 63 | lobe |
| 64 | valley |
| 65 | idle cam direction |
| 66 | large gear rotation direction |
| 67 | multi-lobed cam |
| 68 | bellcrank |
| 69 | follower tip |
| 70 | shoulder screw |
| 71 | follower arm |
| 72 | set screw |
| 73 | stub shaft |
| 74 | cam path groove |
| 75 | finned idle roller |
| 76 | disk element |
| 77 | direction of drum rotation |
| 78 | direction of drum rotation |
| 79 | advancing cutter bar rotation |
| 80 | lagging cutter bar |
| 81 | advancing cutter bar |
| 82 | screw |
| 83 | direction of rotation of cam |
| 84 | rotation of multi-lobed cam |
| 85 | large roll of tape |
| 86 | large gear |
| 87 | motor gear |
| 88 | compressible foot pad |
| 89 | bracket |
| 90 | direction of rotation of idle cam |
| 91 | shoulder screw |
| 92 | slot |
| 93 | threaded hole |
| 94 | set screw |
| 95 | set screw |
| 96 | lobe |
| 97 | center hole |
| 98 | adjustable drum |
| 99 | slotted bearing |
| 100 | adjustment disk |
| 101 | adjustment knob |
| 102 | threaded hole |
| 103 | slotted opening |
| 104 | center hole |
| 105 | indicator |
| 106 | graduated markings |

-continued

| Reference Numerals Used in the Drawings | |
|---|---|
| 107 | wide drum |
| 108 | outboard bearing |
| 109 | support |
| 110 | cutter bar |
| 111 | bearing |
| 112 | roll of web material |
| 113 | excess loop of web material |
| 114 | web section |
| 115 | web segment |
| 116 | support structure |

DETAILED DESCRIPTION OF THE INVENTION

An overview of the preferred embodiment of the present invention is shown in FIG. 1. The roll of tape 3 is mounted on the core holder 6. A section of the tape 4 is peeled and draped, adhesive side up, over the idle roller 7. This same section of tape is extended and adhered to one or more of the multiple cutter bars 2. The cutter bars are mounted in a radial pattern through bearing holes (seen in FIG. 6 as reference numeral 61) in drum 1. Each cutter bar may rotate within each bearing hole. Each cutter bar is governed to refrain from rotating, or urged to rotate according to a cam action, unseen inside the drum. The drum is powered at times to rotate, by means of an electric motor, not shown. From a previous cutting action, there is a segment of tape 5, adhered to a cutter bar and available to the user of the invention. Automatically cutting this tape segment to a fixed length, and making it immediately available to the user, is the purpose of the present invention. The outer construction of the invention consists of the motor cover 8, the midplate 9, the rear cover 10, and the base plate 11. In the preferred embodiment, the invention is powered by electricity through a multi-conductor power cord 12. The midplate and the base plate combine to provide a supporting structure 116.

Figure 2:
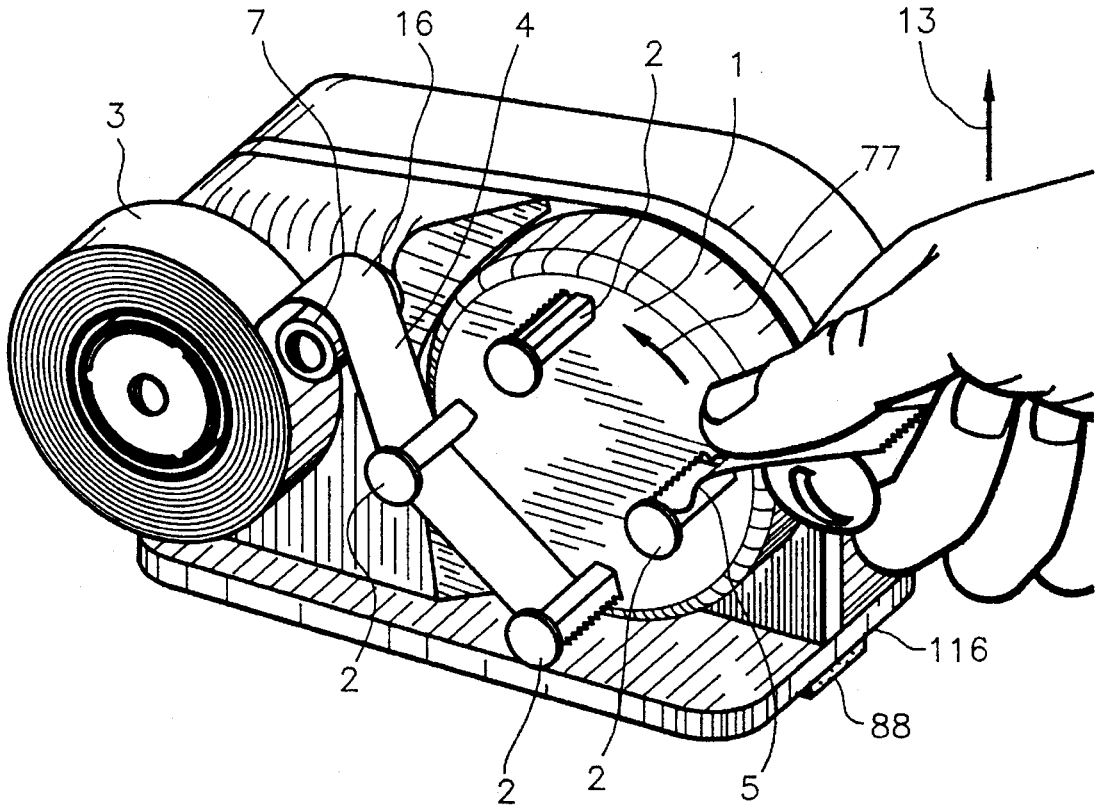
FIG. 2 is a perspective view showing a cut segment of tape being removed.

The act of removing tape segment 5 is shown in FIG. 2. The user grasps the tape segment and lifts it from cutter bar 2, upward in the direction indicated by reference numeral 13. In so doing, the adhesive exerts an upward force on the cutter bar which creates a torque upon the drum 1, causing it to rotate slightly in the direction indicated by reference numeral 77. The rotary position of the drum and cutter bar are particular such that the cantilever section of the tape is convenient to grasp and that upward lifting creates drum torque. By contrast, if the dispensing position of the cutter bar were at the top quadrant of the drum, then lifting the tape would create no drum torque.

Referring again to FIG. 2, the weight of the invention, at the end near the dispensed tape segment, should be greater (but only slightly so) than the upward unsticking force required to free the tape segment. Otherwise, the invention might inadvertently and undesirably rise completely from its resting surface when pulling upward on the tape segment. However, it is advantageous for the invention to rest upon a compressible foot pad at this same end, such as is shown by reference numeral 88. This will cause the body of the invention to raise up slightly during the tape lifting act. This prolongs the time period during which the upward unsticking force acts, thereby enhancing the success of the automatic start-up feature which will be described later.

Ordinarily, there is a significant drag force associated with peeling a section of tape 4 from the tape roll 3. However, there is a loop of excess tape 16 passing over and above the idle roller 7. Because of this, there is no tape drag torque restraining the rotation of the drum. It can be realized then, that the act of lifting the tape segment causes the drum to rotate freely a few degrees. This rotation lessens the amount of excess material in loop 16, but does not exhaust it. Later descriptions will show how this drum rotation automatically starts the motor, and powers the drum to rotate further in direction 77.

Figure 3:
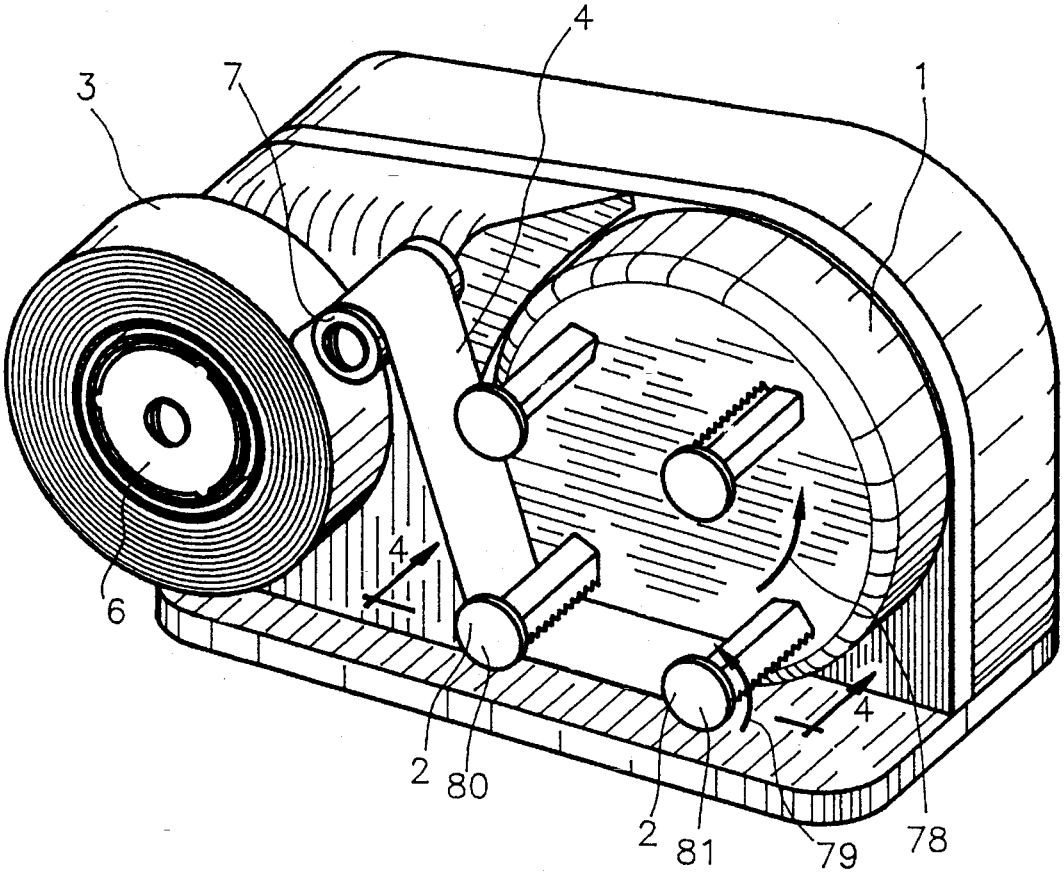
FIG. 3 is a perspective view showing the cutting action of the next segment of tape taking place during a feed and cut cycle.

The view in FIG. 3 takes place later in time from the view in FIG. 2. The drum 1 is being powered to rotate in the direction indicated by reference numeral 78. The idle roller 7 has now lifted due to an unseen cam action which will be described later. The lifting of the idle roller, combined with the rotation of the drum, causes the tape section 4 to bear upon and around the idle roller, thereby causing an additional length of new tape to be peeled from the tape roll 3. In this view, the "lagging" cutter bar is a cutter bar 2 which is in the position designated by reference numeral 80. At this position, there is little or no rotation of the lagging cutter bar within its bearing in the drum, because the unseen cam action has been designed thusly. Now, another cutter bar (to which the end of the tape section is adhered) is further designated as the "advancing" cutter bar 81. It has now advanced to the position where the internal cam action causes it to rotate in the direction indicated by reference numeral 79.

Notice that the advancing cutter bar rotates relative to the drum 1, while the drum itself is also rotating. It can be realized, then that there is an ever-increasing tension in the portion of the tape section between the lagging cutter bar and the advancing cutter bar. This tension is created by the difference in rotation rates of the advancing cutter bar versus the lagging cutter bar.

Figure 4:
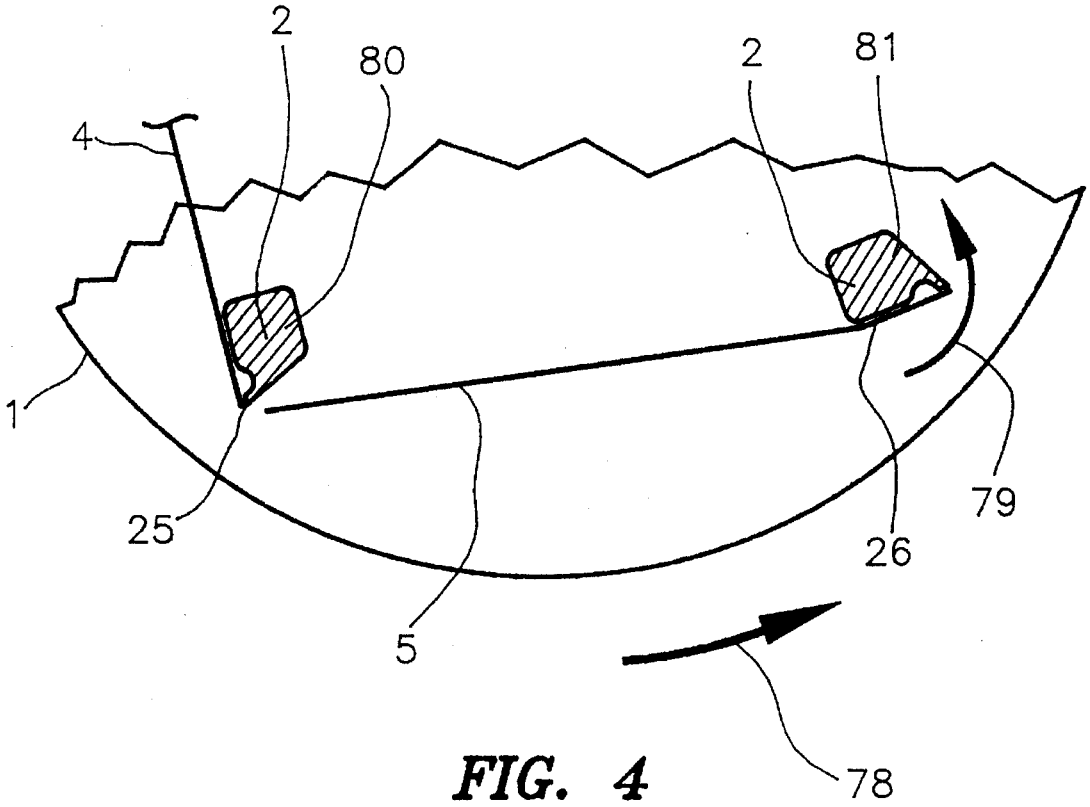
FIG. 4 is a cross-section view of the cutting action, taken along line 4—4 of FIG. 3.

FIG. 4 takes place later in time from the view in FIG. 3. It takes place at the instant when the end of the tape section 4 becomes separated into a newly-formed tape segment 5. This view shows a cross section through two cutter bars 2 designated as lagging cutter bar 80 and advancing cutter bar 81. When the advancing cutter bar rotates in the direction indicated by reference numeral 79, the tape adhesion is increased due to a wrapping action onto the flat 26. It should be noted here, that the preferred embodiment comprises the flat as an optimal means for adhering, however the cutting action described herein will work without a flat, per se, as long as there is some surface upon which to adhere and wrap. The flat is a feature that also orients and controls the free cantilever portion of the tape segment when it will be dispensed later. The lagging cutter bar is stationary or slow-turning relative to the drum 1. Since the distance between the cutter bars is fixed, the higher rotation rate of the advancing cutter bar causes the tape section to become tense, stretch, and ultimately to tear apart against the serrated cutter edge 25 of the lagging cutter bar. It should be noted that the preferred embodiment comprises the serrated cutter edge, however the cutting action will also work with an uninterrupted sharp edge. The cutter may also be straight or curved, or have an edge which is non-parallel to the axis of the cutter bar.

Figure 5:
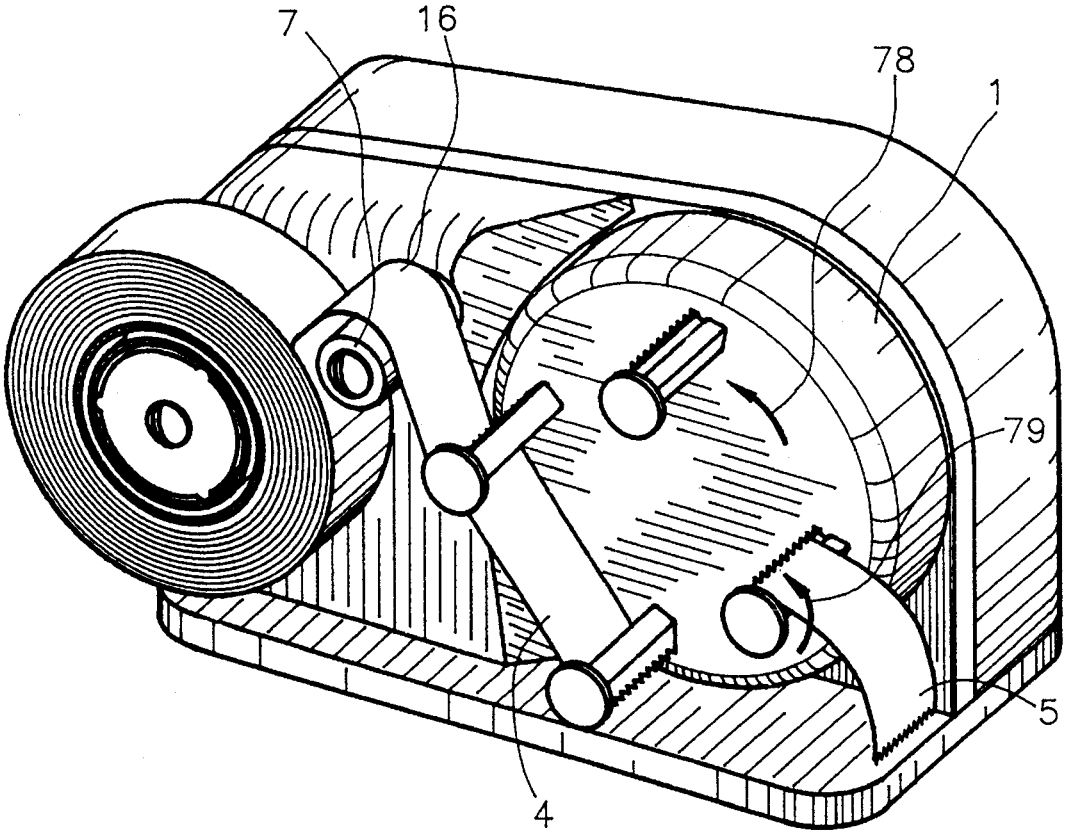
FIG. 5 is a perspective view of the invention near the end of the cycle, where the idle roller drops, and a new segment of tape is presented.

FIG. 5 shows a view of the invention later in time than that shown in FIG. 4. Now the drum 1 has rotated nearly to the end of the cycle. The idle roller 7 is shown having just dropped to the low position by an unseen cam action, thus creating another loop of excess tape 16. Immediately hereafter, the motor will stop by an unseen cam switching action, causing the drum rotation to stop. Then, at the end of the cycle, the invention would again appear as it did in FIG. 1.

The rising of the idle roller 7 during the cycle, and the subsequent rapid dropping of the idle roller near the end of the cycle creates a loop 16 of surplus tape material. However, there are other means and methods of creating a loop. For example, the turning of the drum 1 could be reversed a short time just before the end of the cycle. Also, the core holder 6 could be translated or rotated rapidly toward the drum near the end of the cycle.

Figure 6:
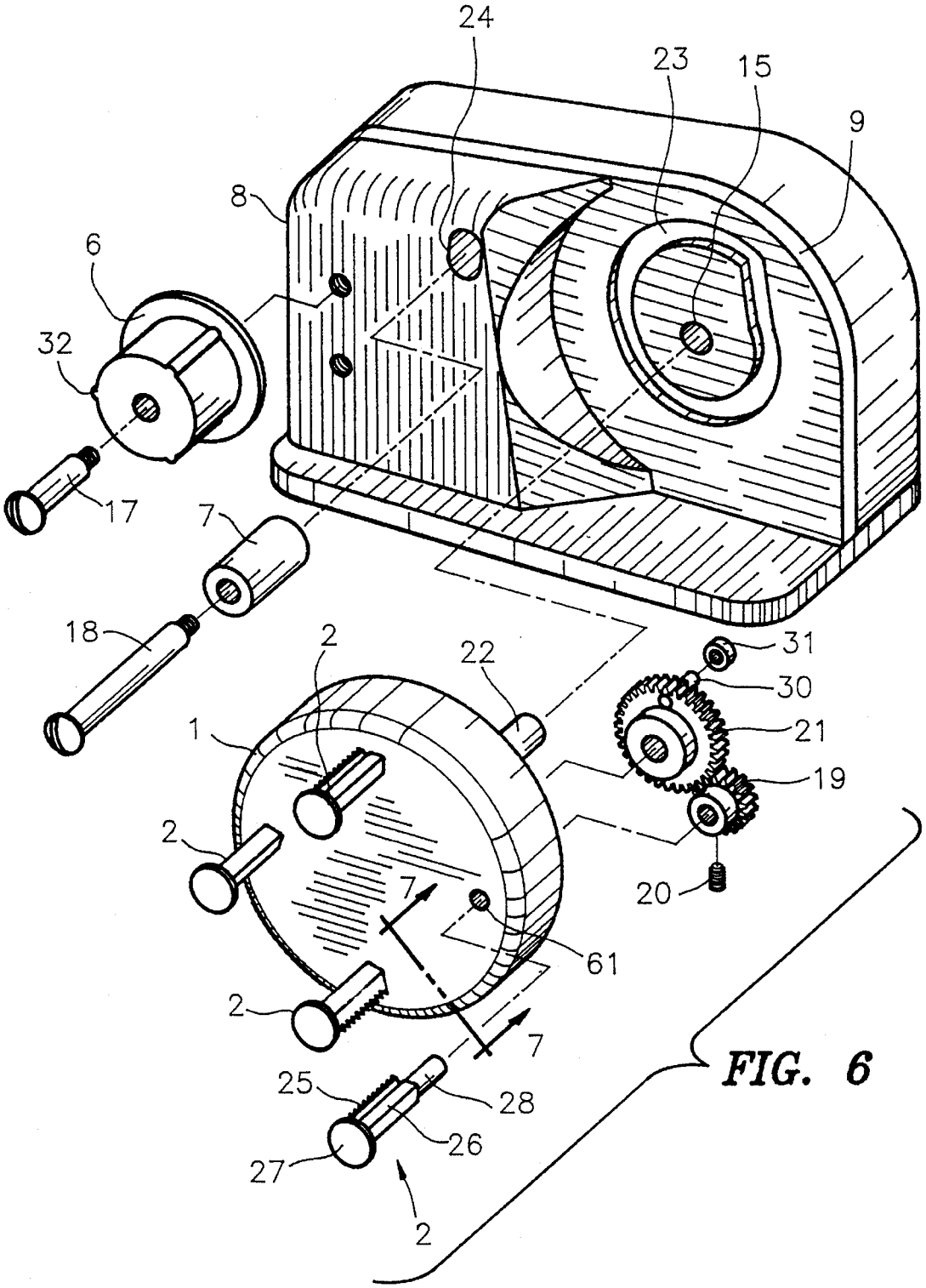
FIG. 6 is an exploded perspective view, with the roll of tape not shown, which reveals the cutter bar rotation means behind the drum.

The parts making up the front side of the invention are shown in the exploded perspective view of FIG. 6. The motor cover 8 is a hollow thin-walled part which is fastened to the midplate with screws from the other side (not shown) in order to cover and protect a portion of the gearmotor (not shown), and to provide a base for the threaded attachment of the shoulder screw 17. There is a slotted opening 24 through which the idle shaft 18 passes, and through which it can freely translate up and down.

The core holder 6 has multiple ridges 32 which enhance the frictional attachment of the roll of tape 3. The core holder is supported by and may freely rotate about shoulder screw 17. The idle roller 7 is supported by and may freely rotate about the idle shaft 18.

The drum 1 is shown in FIG. 6 removed from the midplate 9. It is supported by and is permanently attached to the main shaft 22 by means of a set screw (not shown) or by a forced fit. One of the multiple cutter bars 2 is shown removed, revealing the serrated cutting edge 25, the flat 26, the end cap 27, and the cylindrically-shaped shaft end 28. The end cap acts as an edge guide for the tape and also to guard the cutting edge. The shaft end of each cutter bar passes through its respective bearing hole 61 in the drum and is constrained axially by the cutter gear 19, which is also fixed in a preferred rotary position by set screw 20. The cutter gear meshes with the cam gear 21. The cam roller 31 fits loosely over the stub shaft 30, which is fixed at an eccentric position in the cam gear. There is a recessed cam path groove 23 in the midplate, around which the cam roller travels. Also, there is a bearing opening 15 through which the main shaft passes and is supported.

Figure 7:
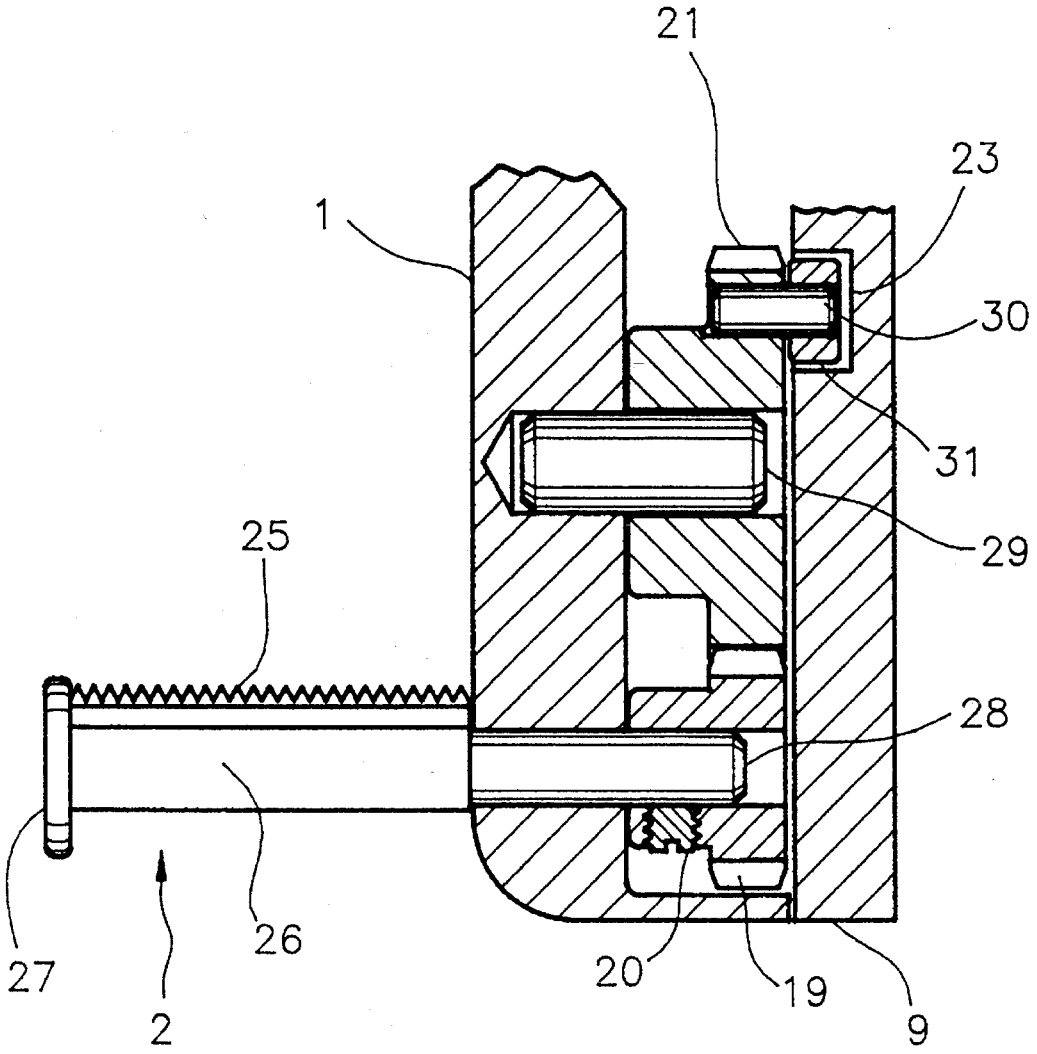
FIG. 7 is a cross-section view, taken along line 7—7 of FIG. 6 which shows meshing gears and the cam follower.

FIG. 7 is a cross-sectional view taken along line 7—7 of FIG. 6, showing the mechanism within the drum 1. Each cutter gear 19 meshes with a cam gear 21. Each cam gear is supported by and is free to rotate about a fixed shaft 29 which is permanently fixed in the drum. Each cam gear has a permanently fixed stub shaft 30. Each cam roller 31 is mounted on and is free to rotate about each stub shaft. Although not individually detailed, there is an identical grouping of parts such as is shown in FIG. 7 for each and every cutter bar. Generally, each cam gear has more teeth than each cutter gear. Therefore, the angular displacement of each cutter bar is somewhat larger than that experienced by each corresponding cam gear.

It can be seen that, as the drum 1 is powered to rotate by the main shaft 22, each cam roller 31 slides or rolls along and inside of the cam path groove 23 in the mid plate 9. As it does, forces and rotations are imposed upon each cam gear 21, which in turn meshes with each cutter gear 19, thereby powering each cutter bar 2 to rotate and possess a useful torque.

A cam path groove shape, such as the one shown as reference numeral 23, can be developed by one knowledgeable in the art, which produces the desired rotary action and torques as described in FIGS. 1 through 5, as a function of rotary drum position.

Figure 8:
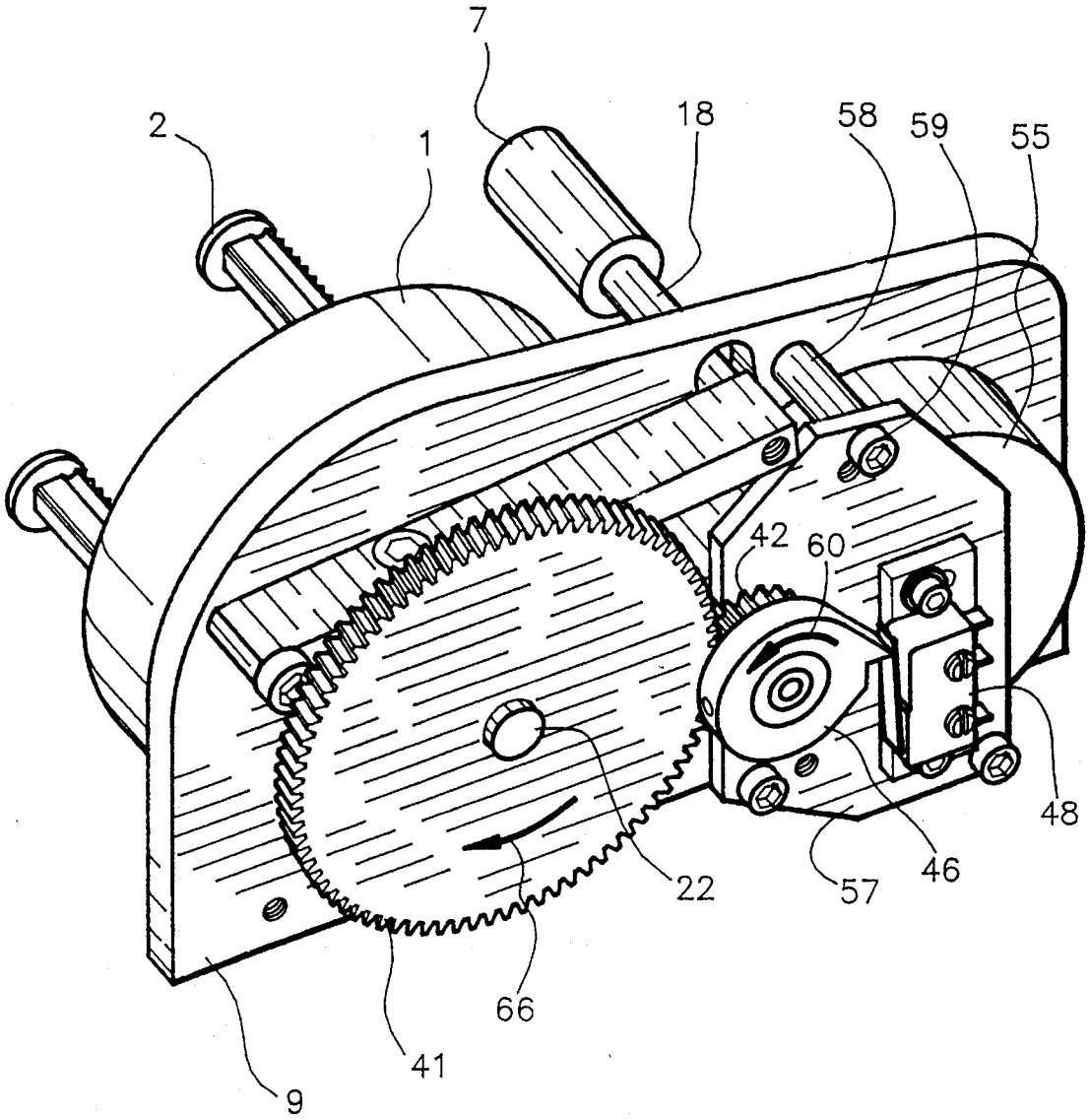
FIG. 8 is a perspective view of the rear of the invention with the rear cover, motor cover, base plate, electrical wiring, and power cord removed.

FIG. 8 shows the rear of the invention with the protective rear cover 10 removed for clarity. The electrical wiring, the motor cover 8, and the base plate 11 are also not shown. The main shaft 22 can be seen on this side, having passed through the midplate 9.

The power to turn the main shaft 22 is transmitted through the meshing of the large gear 41 and the motor gear 42. In the preferred embodiment, the ratio of the number of teeth on the large gear divided by the number of teeth on the motor gear is equal to the quantity of cutter bars 2. This being so, the motor gear and the cam 46 will turn one revolution during each cutting cycle of the present invention.

When the gearmotor 55 is energized, the gears turn in the directions shown by the reference numerals 66 and 60. The gearmotor is mounted with screws (not shown) to the back side of the motor plate 57, which itself is fastened by screws 59 and spacers 58 into the midplate 9. A switch 48 is mounted upon the motor plate at a position where it can be activated by the cam 46.

Figure 9:
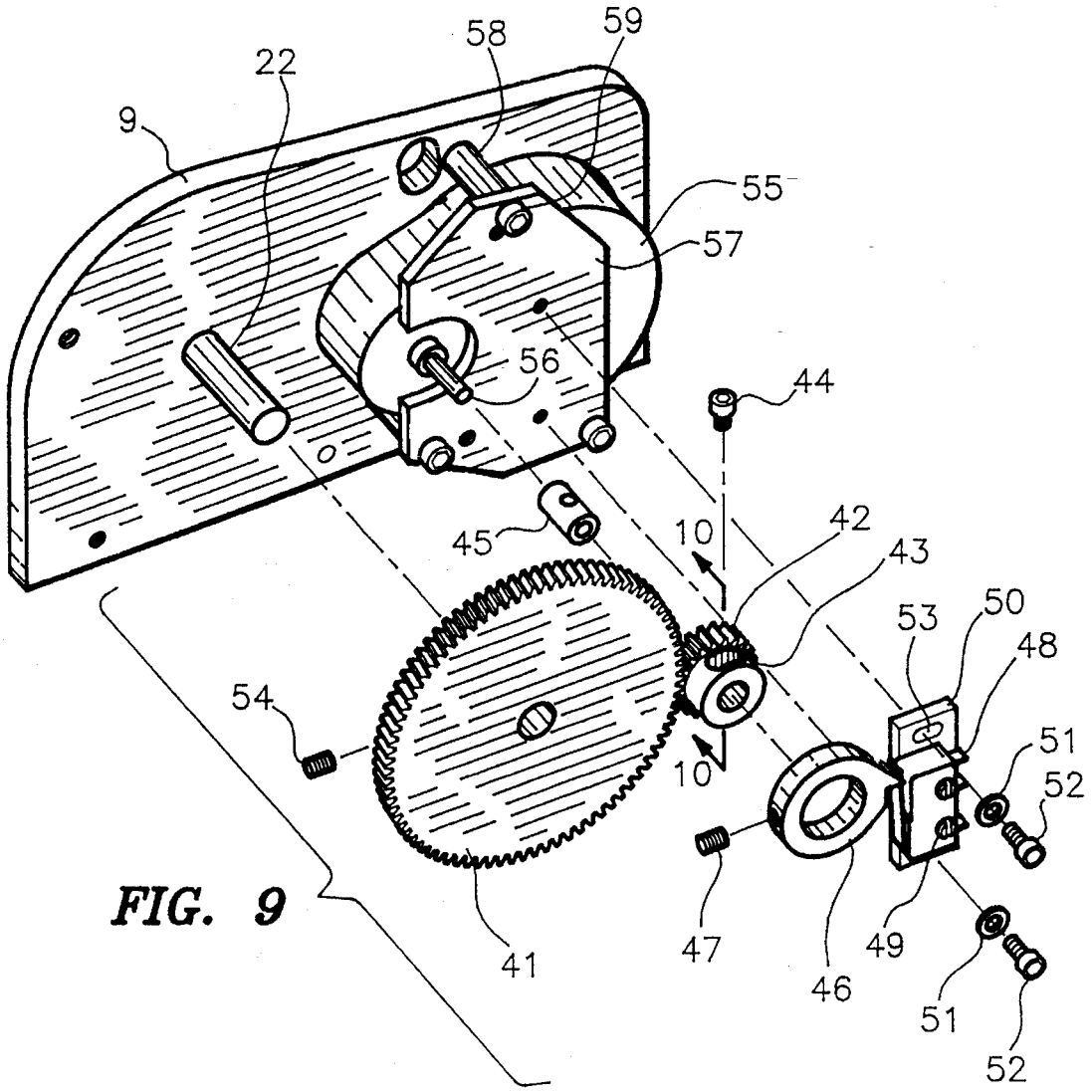
FIG. 9 is an exploded perspective view showing the power transmission gearing and the cam action of the electrical switch.

FIG. 9 shows an exploded perspective view of the rear of the invention. The switch 48 is shown fixed to the switch plate 50 by screws 49. The switch plate is then mounted to the motor plate 57 by screws 52 and washers 51 which pass through slotted openings 53 in the ends of the switch plate. In this way, the position of the switch can be adjusted as desired to interact with the cam 46.

The large gear 41 is shown fixed to the main shaft 22 in a preferred angular position by the set screw 54. The bushing 45 is fixed onto the motor shaft 56 by the cap screw 44. The motor gear 42 has a slotted opening feature 43. The motor gear is mounted on and is free to rotate to a limited extent about the bushing. During assembly, the cap screw is inserted through the slotted feature and then threaded into the bushing and finally secured against the motor shaft. When the gearmotor 55 is energized, the motor shaft, the bushing, and the cap screw, all turn in unison. However, at such time as the cap screw comes in contact with end of the slotted feature, then the motor gear and cam 46 are also driven to rotate, powered by the gearmotor. The cam is fixed to the motor gear in a preferred angular position by the set screw 47.

Figure 10:
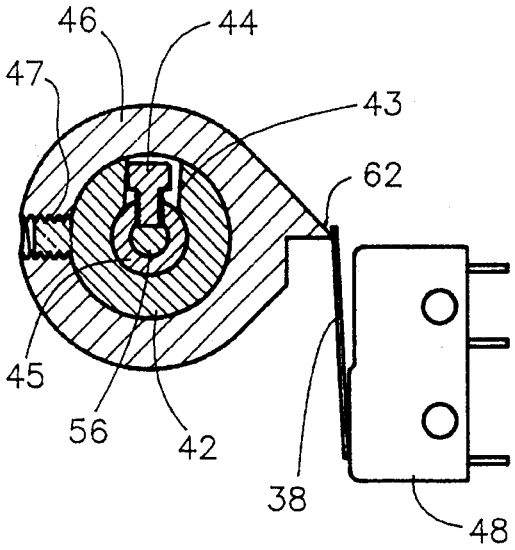
FIG. 10 is a cross-section view, taken along line 10—10 of FIG. 9 in the nominal state, after the end of a cutting cycle.

This being so, the relationship of the internal parts shown in FIG. 10 would prevail during most of the cutting cycle, where the motor and gears are driving against the load and against friction. Likewise, FIG. 10 shows precisely the relationship of parts at the end of a cutting cycle, where the action has been stopped by the lobe 62 of the cam 46 depressing the leaf 38 of switch 48 causing it to throw to the electrically open position, causing the gearmotor to stop. FIG. 10 can also be understood to show the nominal stopped position of the parts in the rear of the invention, when the parts in the front of the invention are in the position shown in FIG. 1.

Figure 10A:
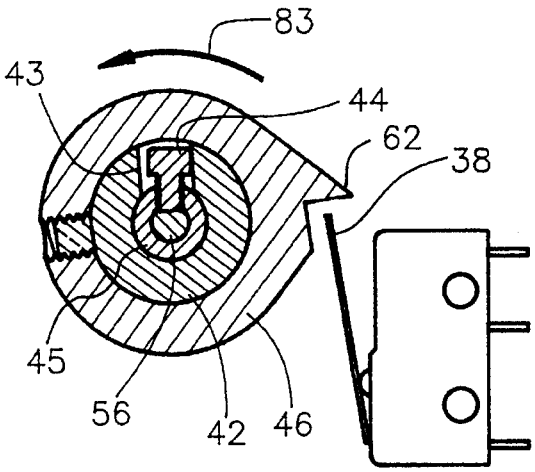
FIG. 10A is a cross-section view, taken along line 10—10 of FIG. 9 when the automatic motor start-up means is activated.

A novel feature of the present invention is the automatic gearmotor start-up means which is initiated by the lifting of the tape segment 5 in FIG. 2. The rotary movement described in FIG. 2 is transmitted through the main shaft 22 and large gear 41 to encourage the motor gear 42 and the cam 46 to advance in direction referenced by numeral 83 in FIG. 10A. If not for the limited rotary freedom afforded by the slotted opening 43, the cam would be discouraged from rotating by the stopped motor shaft 56 and all parts secured to it. However, it now can be realized that the lifting of the tape, causes immediate cam rotation in unison with the drum rotation, whereupon the leaf 38 drops, causing the switch 48 to throw to the electrically closed position, causing the gearmotor 55 to start-up, initiating another cutting cycle.

To fully exploit the automatic start-up means, the mass of the parts involved should be minimized. Therefore, they might be fabricated of aluminum or plastic. Also, the friction of every bearing surface should be minimized.

Figure 11:
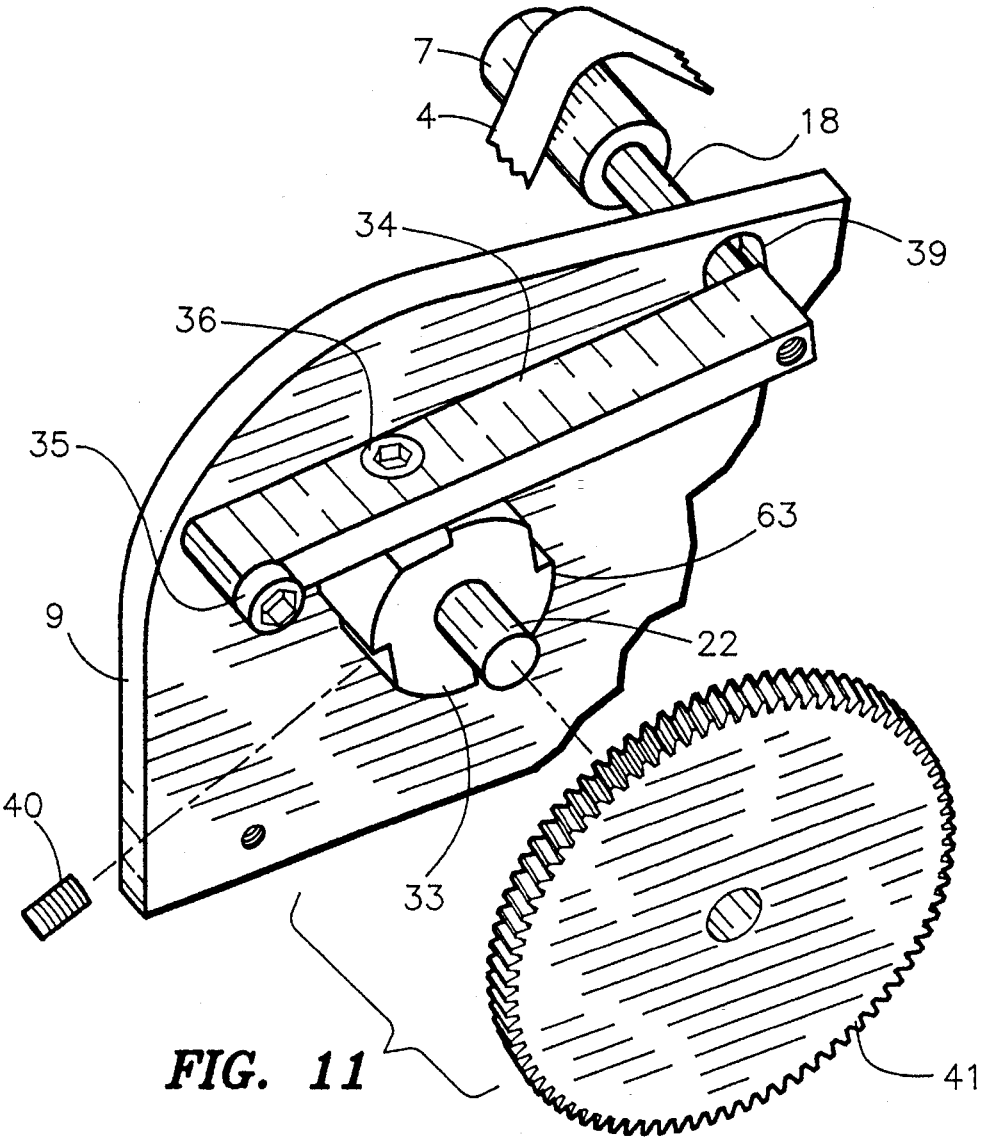
FIG. 11 is an exploded perspective view of the idle roller drop cam means.

As earlier described, the loop of excess tape 16 shown in FIG. 2 contributes to the success of the automatic start-up means by eliminating undesirable peel drag on the drum 1. One means of forming this loop is described in FIG. 11. Here, parts are shown which were hidden in FIG. 8 or not shown in FIG. 9. Near the end of each cutting cycle, the idle roller 7 drops abruptly. The idle roller is mounted on and is free to rotate about the idle shaft 18, which passes through and may freely translate up and down in the slotted opening 39 in the midplate 9. The idle shaft is secured against a threaded opening in the side of the lever arm 34. The lever arm is mounted by and is free to rotate about a shoulder pivot screw 35 at the other end, which is screwed into the midplate 9.

The idle cam 33 is fixed to the main shaft 22 by a set screw 40 in a preferred rotary position. The idle cam has multiple high lobes 63 which are equally spaced radially, the number of which, in the preferred embodiment, equals the quantity of the cutter bars 2.

Figure 11A:
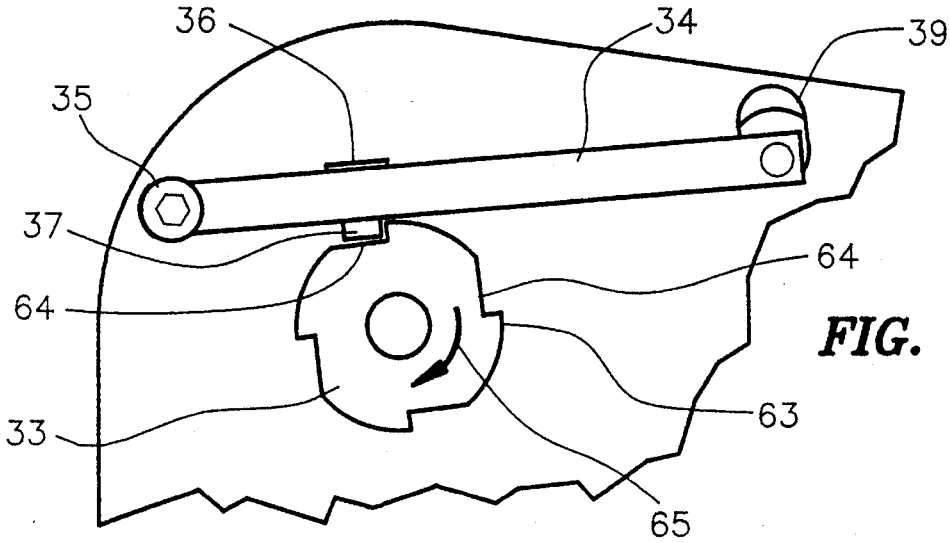
FIG. 11A is a side view of the idle roller drop cam means.

There is a follower screw 36 threaded into the lever arm 34 with a tight fit, which would resist casual rotation. There is a follower tip 37 which can be seen in FIG. 11A on the end of the follower screw. The parts shown are arranged in a preferred way such that a cam lobe 63 at times rotates to lift the follower tip, causing the lever arm to rotate about the pivot shoulder screw 35, and ultimately raising the idle roller 7, and the section of tape 4 passing over it.

At other times, rotation of the idle cam 33 in the direction denoted by numeral 65, causes a lobe 63 to pass out from under the follower tip 37, causing it to abruptly drop into a valley 64, thus ultimately allowing the idle roller 7 to drop, introducing the loop of excess tape 16 as was shown in FIG. 5. It is important that, at this time, the downward travel of the idle roller is limited by the idle shaft 18 stopping against the bottom of the slotted opening 39. In this way, the follower tip does not at any time rest upon the valley. This is important to the success of the automatic start-up means because it prevents the follower tip from adding to the rotational friction of the main shaft 22.

The timing of the idle roller drop is critical to the success of the automatic start-up means. It must take place just an instant before the end of the cutting cycle. By contrast, if it took place very much earlier in the cycle, then the continued rotation of the drum 1 and cutter bars 2 would quickly deplete the formed loop of excess tape 16. Therefore, the rotary attachment position of the idle cam 33 and the position of the follower tip 37 should be adjusted and fixed to give the desired effect.

Figure 12:
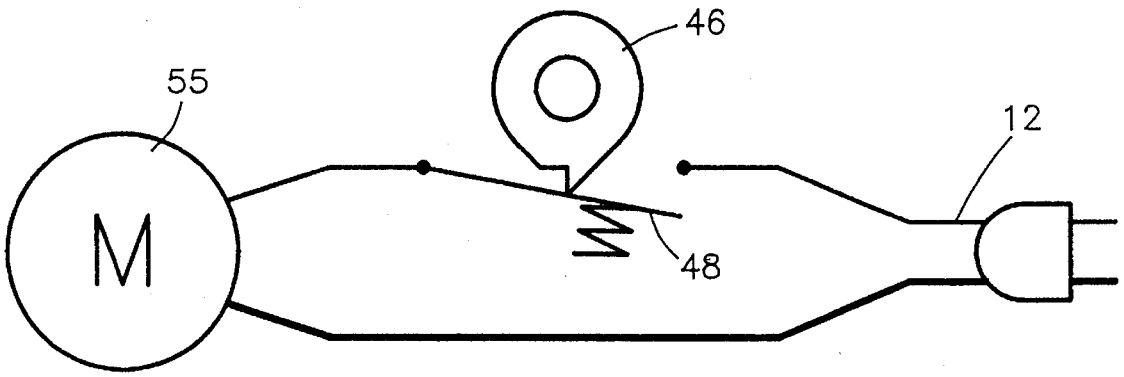
FIG. 12 is an electrical schematic of the preferred embodiment of the invention.

The electrical schematic is shown in FIG. 12. It is shown in the nominal condition where the gearmotor 55 has been stopped at the end of a cutting cycle by the cam 46 acting to electrically open the switch 48, thus interrupting power from the power cord 12.

Figure 13:
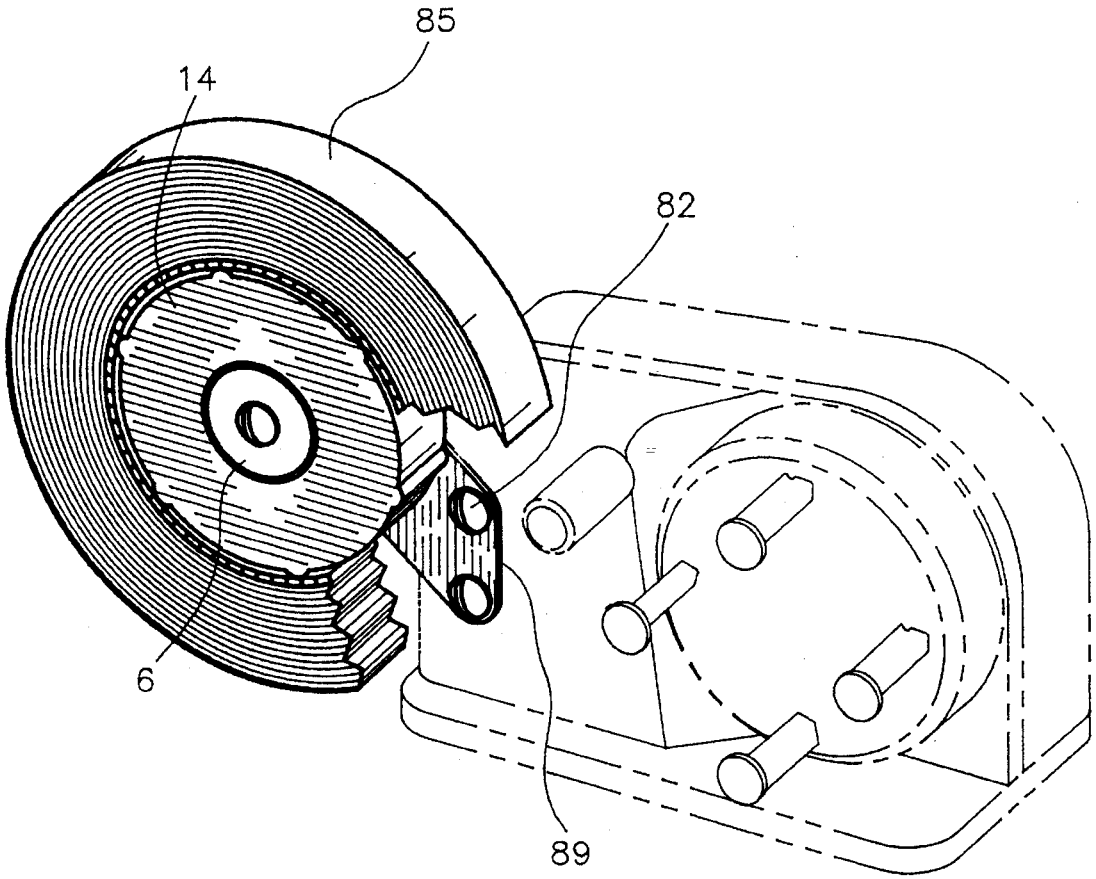
FIG. 13 is a perspective view of auxiliary attachments which allow the dispensing of a roll of tape having a larger diameter.

FIG. 13 shows an alternate embodiment of the present invention which allows the mounting of a large roll of tape 85 on an annular spacer 14 which itself is mounted on the core holder 6. This assembly is supported by an extension bracket 89, secured by screws 82. This assembly would also permit the mounting of a roll of tape which has a large outer diameter and a small core, by omitting the annular spacer 14.

Figure 14:
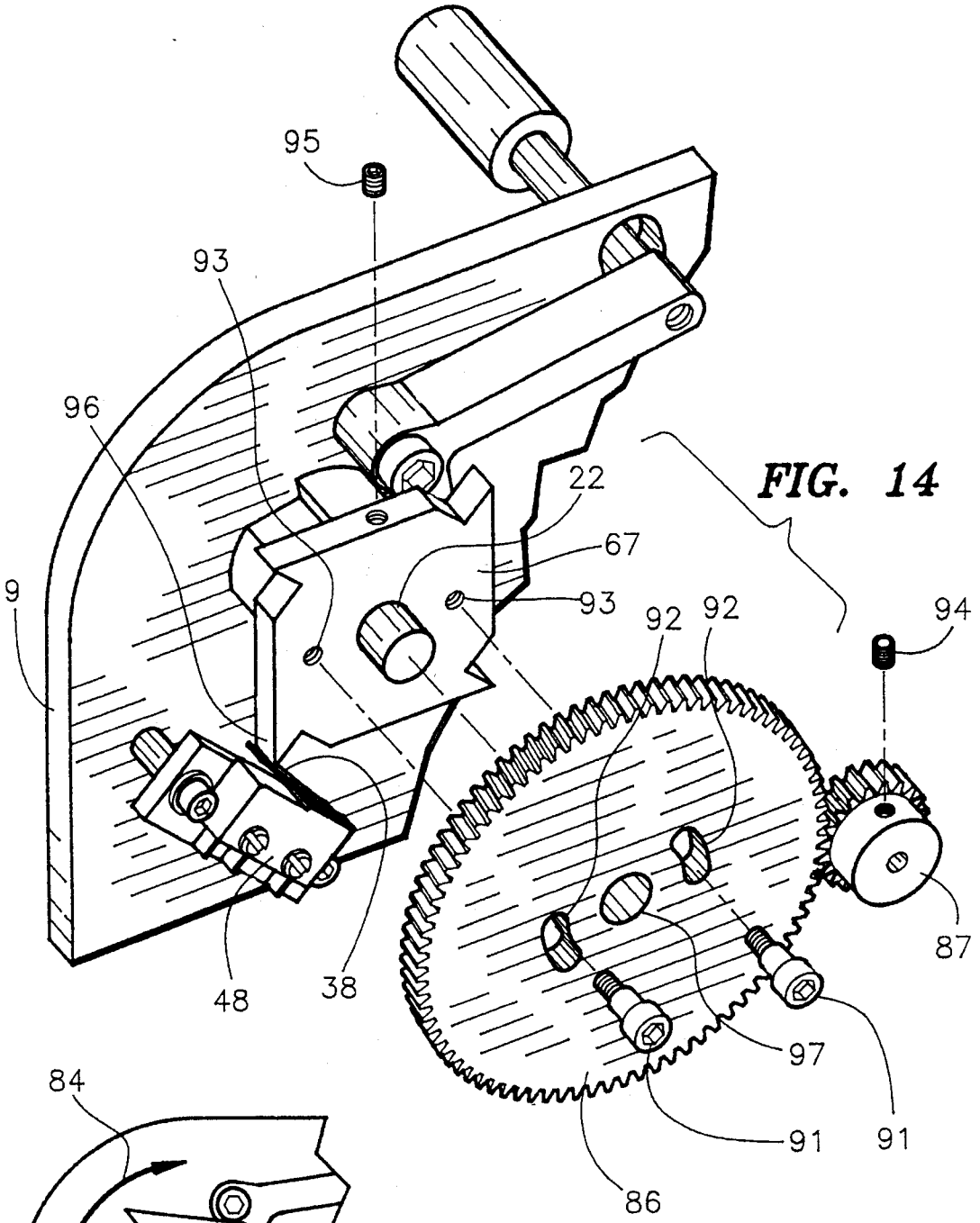
FIG. 14 is a perspective view of an alternate embodiment of the cam action of the electrical switch.
Figure 14A:
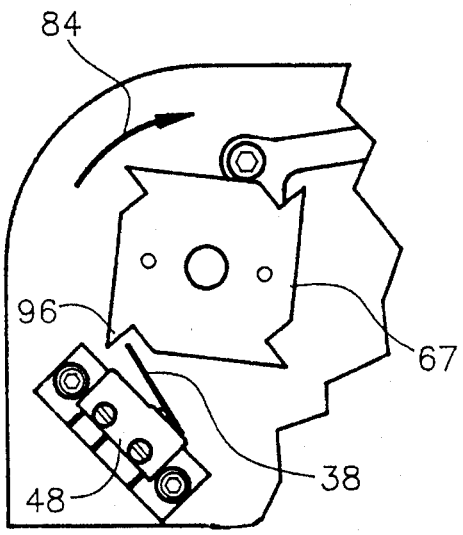
FIG. 14A is a side view of an alternate embodiment of the cam action of the electrical switch where the, automatic start-up means is activated.

An alternate embodiment of the present invention is shown in FIG. 14, where a multi-lobed cam 67 is mounted on the main shaft 22 by a set screw 95. The electrical switch 48 is mounted at an adjacent position which causes the leaf 38 to rise and fall against each of the cam lobes 96 as they may rotate under it. The relationship of these rear parts shown in FIG. 14 would be at the nominally stopped position, at which time, the drum position in the front would be depicted by FIG. 1. The large gear 86 is also mounted on the main shaft 22, but it is free to rotate on it about the center hole 97. One or more shoulder screws 91 pass through the slots 92 in the large gear, and screw securely into threaded holes 93 in the multi-lobed cam. In this way, there is limited free rotation between the large gear and the main shaft. The motor gear is fixed to the motor shaft (not shown) by a set screw 94. As was previously explained, this limited rotary freedom permits the tape lifting event described in FIG. 2 to freely turn the multi-lobed cam 67 in the direction referenced by numeral 84 in FIG. 14A, causing the leaf 38 to fall, throwing the switch 48 to the electrically closed position, and thus starting the gearmotor 55. One advantage to this embodiment, is that there is less rotational friction and inertia, since neither the large gear 86, nor the motor gear 87 are required to rotate during the automatic start-up action. Another advantage to this embodiment, is that the ratio of the number of teeth on the large gear divided by the number of teeth on the motor gear is not restricted to be an integer value.

Figure 15:
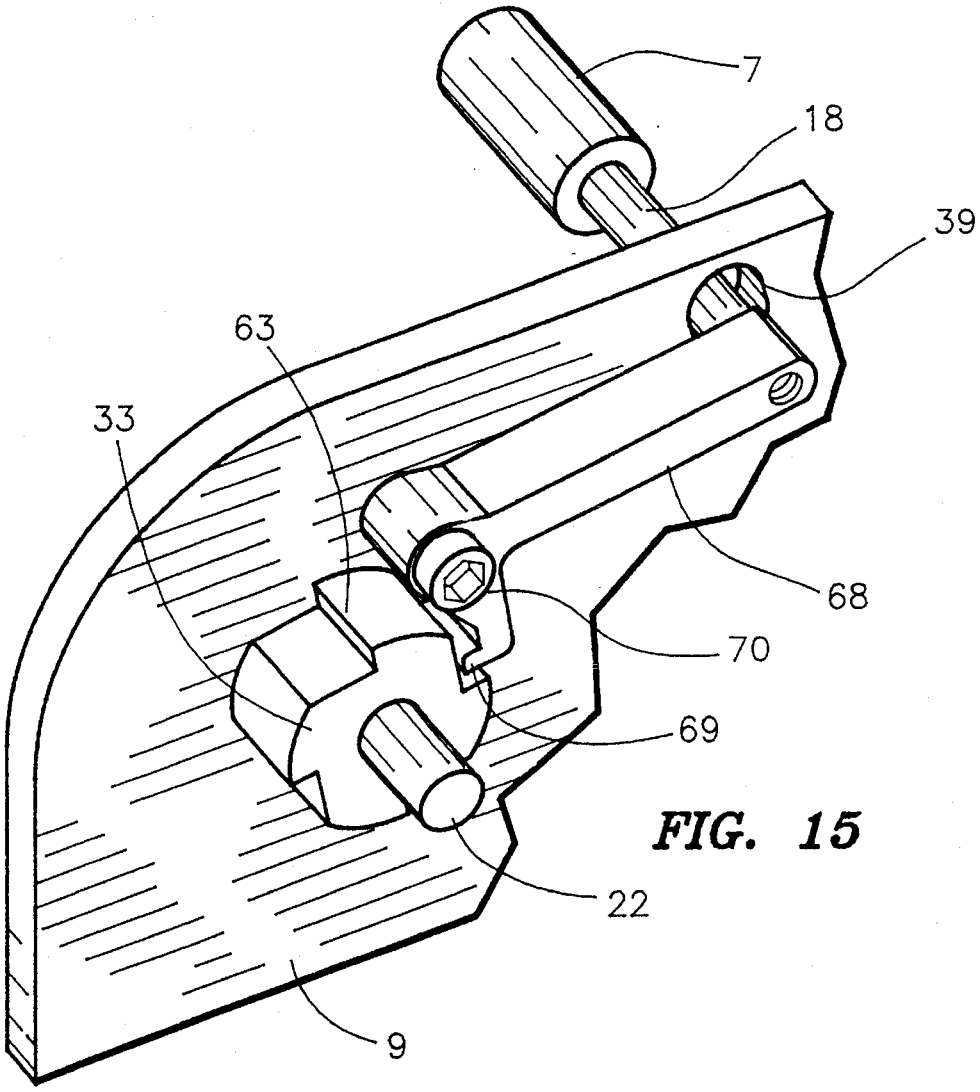
FIG. 15 is a perspective view of an alternate embodiment of the idle roller drop cam means.
Figure 15A:
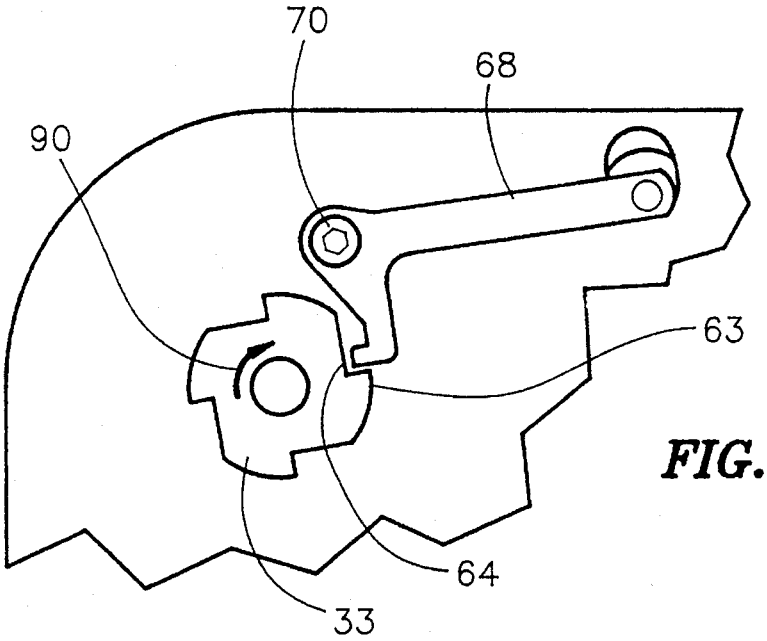
FIG. 15A is a side view of an alternate embodiment of the idle roller drop cam means.

An alternate embodiment of the present invention is shown in FIG. 15, where the idle roller drop mechanism comprises the idle cam 33 secured to the main shaft 22 in a preferred rotary position by a set screw, not shown. However, there is shown a bell crank 68 which is secured and is free to rotate around a shoulder pivot screw 70. There is follower tip 69 against which the lobes 63 push at times during the rotation of the idle cam. FIGS. 15 and 15A show the nominal position soon after the cam has turned in the direction denoted by numeral 90, the idle roller 7 has dropped, limited in travel by the idle shaft 18 striking against the lower edge of the slot 39. In this way, the follower tip 69 never comes in contact with any valley 64. One advantage of this embodiment, is that the idle roller 7 may be mounted at a further distance from the drum 1, affording more clearance. Another advantage of this embodiment, is that the mechanical advantage of the idle roller motion can be more easily designed to suit the conditions, by changing the geometry of the bell crank.

Figure 16:
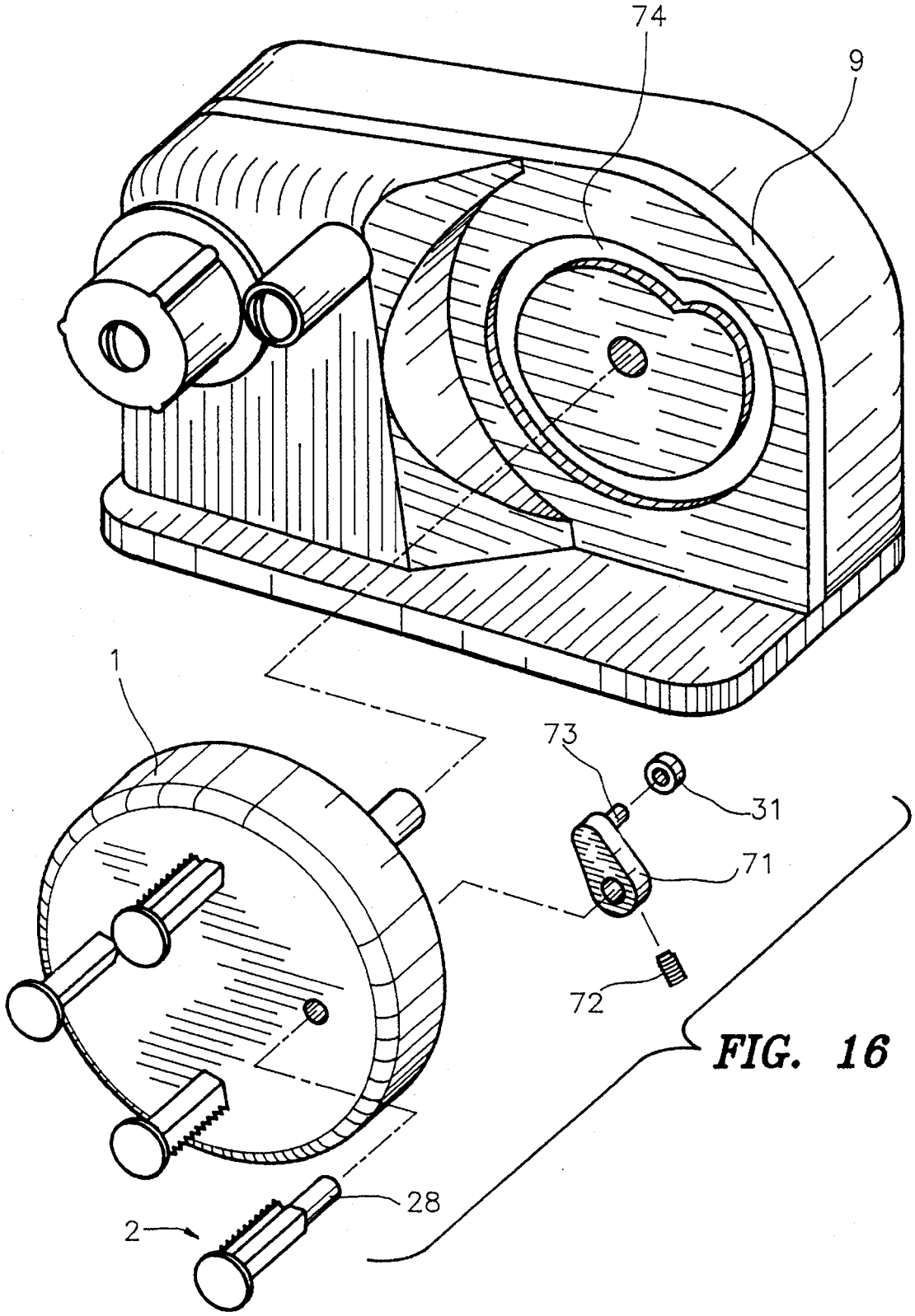
FIG. 16 is an exploded perspective view of an alternate embodiment of the cutter bar rotation means.

An alternate embodiment of the present invention is shown in FIG. 16, which shows another means of controlling the rotations of the cutter bars 2. Each cutter bar shaft end 28 passes through its respective hole in the drum 1 and is constrained axially by the follower arm 71, which is also fixed in a preferred rotary position by set screw 72. Each cam roller 31 is mounted on and is free to rotate about stub shaft 73 which is fixed permanently into the end of the follower arm.

It can be seen that, as the drum 1 is powered to rotate, each cam roller 31 follows the travel prescribed by the cam path 74. Likewise, it can be seen that, through the action of each follower arm 71, each cutter bar 2 is powered to rotate and to possess a useful torque. A cam path shape, such as the one shown as reference numeral 74 can be developed by one knowledgeable in the art, which produces the desired rotary action and torques as described in FIGS. 1 through 5, as a function of rotary drum position. The advantage of this embodiment is that the cutter bars are more directly powered by the follower arms, rather than through the pair of gears shown in FIG. 6. However, this is not the preferred embodiment because the range of rotary motion through which each cutter bar can be made to rotate is more limited, and the geometry begs the relocation of the center line of each cutter bar radially inward so as to maximize the useful range of the follower arm swing.

Figure 17:
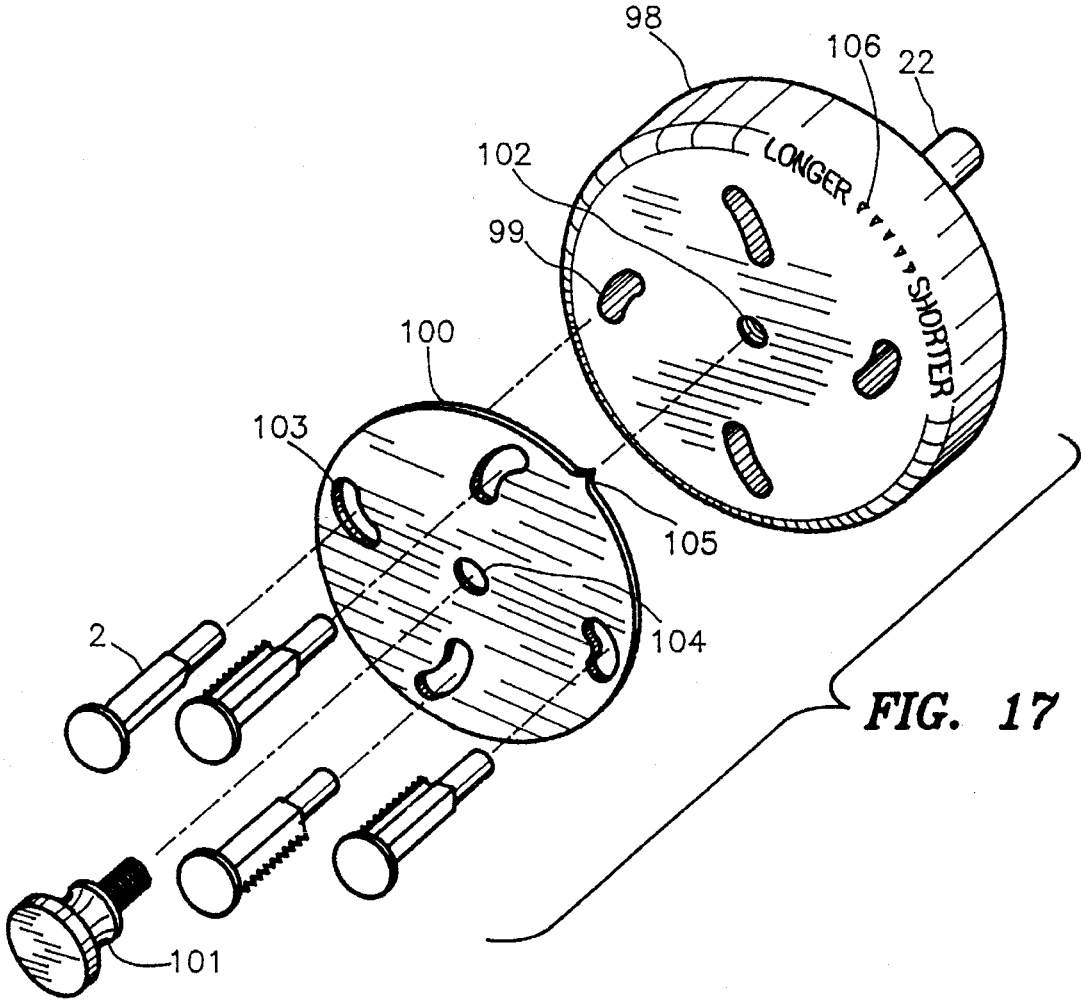
FIG. 17 is an exploded perspective view of an alternate embodiment of the drum assembly which allows for the adjustment of the length of the tape segment.

An alternate embodiment of the present invention is shown in FIG. 17, where only the drum assembly is shown. This shows an additional feature which allows the user to pre-adjust the length of the tape segment. The adjustable drum 98 provides for a range of radial movement of each of the cutter bars 2 by means of a slotted bearing 99, whose number equals the number of cutter bars. The orientation of the longitudinal axis of each slotted bearing may be radial or at an angle to a radial line. Also, the longitudinal axis of each slotted bearing may take the form of an arc, especially where this facilitates the constant meshing of a cutter gear 19 not seen on the other side of the drum. An adjustment disk 100 is attached to the front of the adjustable drum by means of an adjustment knob 101 which passes through center hole 104 and fastens into threaded hole 102. The adjustment disk has slotted openings 103, through which each of the cutter bars passes. The slotted openings are equidistant from one another, and are oriented with their longitudinal axes forming a predominantly spiral shape. The longitudinal axes of the slotted openings may also be straight and at some angle relative to radial lines. However, this feature will not operate properly if the longitudinal axes of the slotted openings are either radial or circumferencial to the adjustment disk. The threaded hole 102 is adjacent but not common to the main shaft 22. Therefore, turning the adjustment knob has no affect on the rigidity by which the adjustable drum is attached to the main shaft.

Now the length of each tape segment 5 which is cut by the present invention is governed by the distances between adjacent cutter bars 2. The mechanism shown in FIG. 17 is used to adjust and fix these distances. By loosening the adjustment knob 101, the adjustment disk 100 may be turned relative to the adjustable drum 98. When turned, the slotted openings 103 work in coaction with the limited travel afforded by the slotted bearings 99; the result being that the cutter bars are all moved simultaneously and yet equidistantly to larger or smaller distances from one another. Finally, the adjustment knob is tightened. There are one or more indicators 105 on the adjustment disk which, when aligned with one or more graduated markings 106 on the adjustable drum, provide the user with a visual indication of the length of the tape segment which will be cut.

Figure 18:
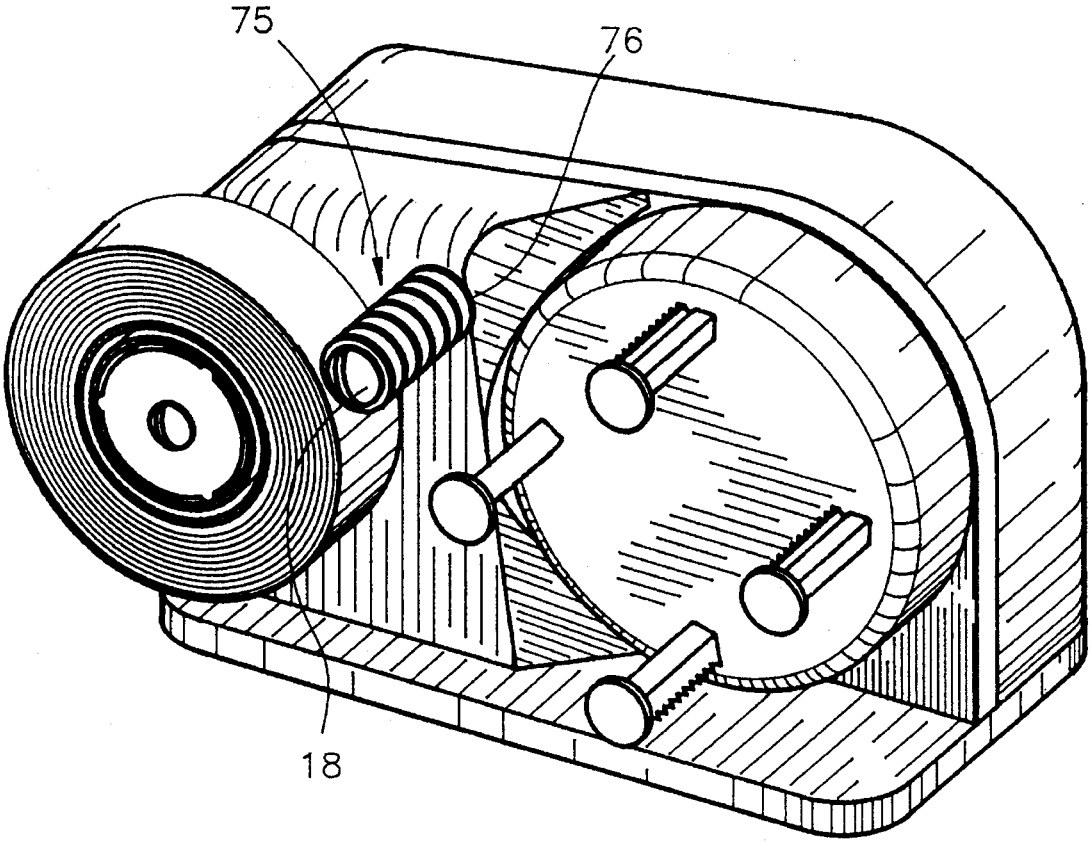
FIG. 18 is a perspective view of an alternate embodiment of the idle roller, which would permit the successful dispensing of a tape which has adhesive on both sides.

An alternate embodiment of the present invention is shown in FIG. 18, in which the tape section 4 is removed to reveal an alternate design of the idle roller. Here, a finned idle roller 75 is shown. The finned shape is a result of its construction which is comprised of a number of thin disk elements 76 having identical outer diameters. These are arranged co-axially and contiguous to a common center cylinder which is mounted on and is free to rotate about the idle shaft 18. These disk elements are separated axially by distances sufficiently small so as to allow the tape to be adequately supported upon and around the thin outer edges of the disks. The surface of the disk elements may be treated with a coating or may be constructed of a material which resists the adhesion of the tape. The advantage of this embodiment, is that it permits the cutting and dispensing of tape which has adhesive on both sides, whereby the finned construction and the surface of the fins minimizes the undesirable adhesion to the finned idle roller.

Figure 19:
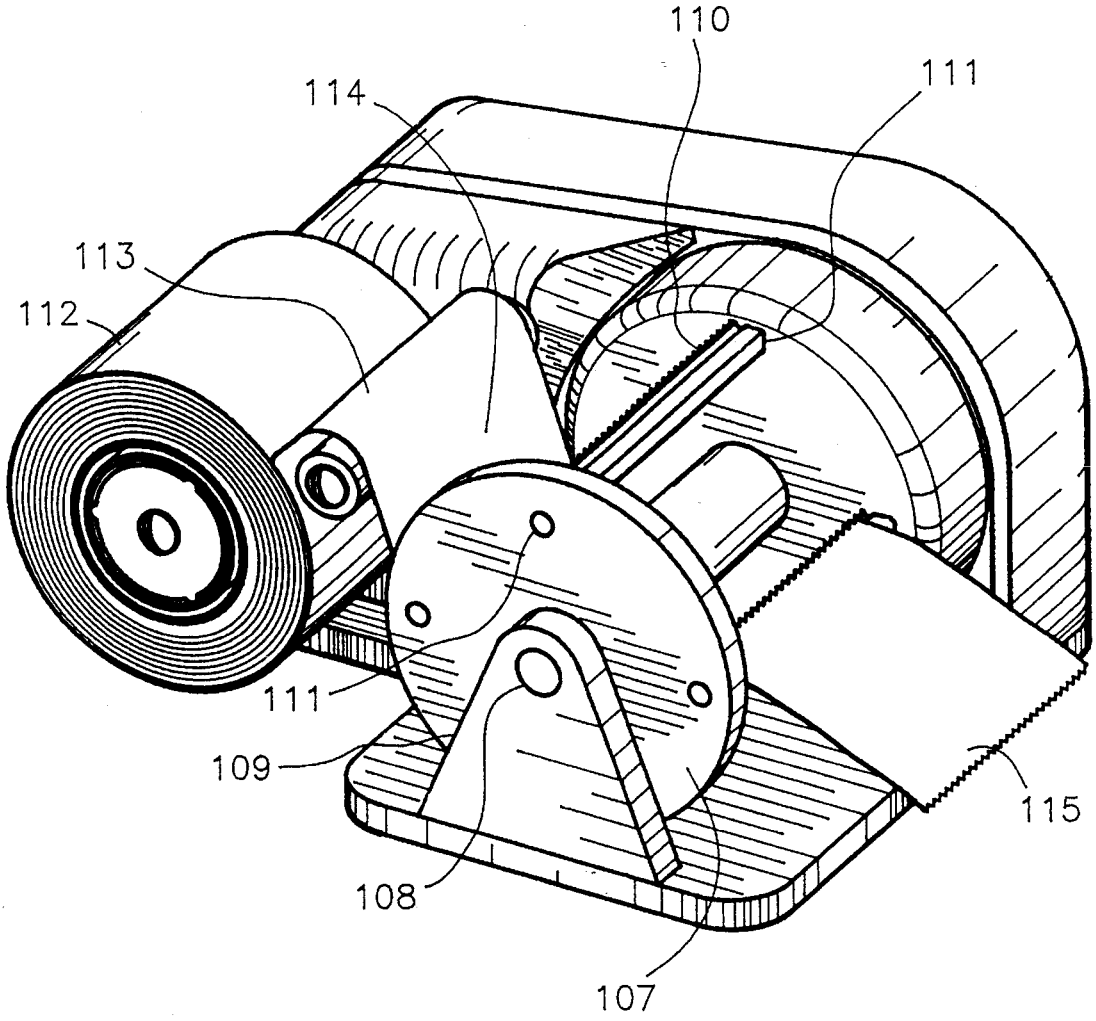
FIG. 19 is a perspective view of an alternate embodiment of the drum construction which permits the use of a much wider tape or web product.

An alternate embodiment of the present invention is shown in FIG. 19, where there is a wide drum 107 which is additionally supported by an outboard bearing 108 mounted in a support 109. Each of the cutter bars 110 is also shown lengthened and is supported and enabled to rotate by bearings 111 at both ends. Additionally, there may be a number of intermediate bearings, not shown, spaced apart from one another so as to provide sufficient rigidity to each cutter bar. Thus, there is no practical limit to the width of the material which can be cut and dispensed by this invention. This being the case, the more general term of "web" can also be used to describe the material which is cut and dispensed by the present invention. Specifically shown are the roll of adhesive web material 112, the excess loop of web material 113, the section of web material 114, and the web segment 115.

While the present invention has been described with respect to the specific embodiments illustrated, it is understood that the invention can be modified in various ways. For instance, the mechanism for cutting and advancing the tape could be adapted for use in various packaging or labelling machines which would utilize or apply the tape segment directly without human intervention. These and other modifications are to be deemed within the spirit and scope of the following claims.

What is claimed is:

1. Apparatus for sequentially cutting a web product, having adhesive on at least one side, into web segments comprising:

(a) a drum, (b) a plurality of cutter bars, which are mounted in a radial pattern in said drum, wherein said cutter bars individually rotate, and wherein a feature of each cutter bar is a sharp edge, whereby said web is extended and adhered to one or more of the cutter bars, (c) a means of powering the drum to rotate, whereby the web is advanced by sequentially adhering to the cutter bars, (d) a means of powering the cutter bars to rotate at different rotational rates and angular positions from one another, whereby a web spanning between two cutter bars becomes increasingly tense and tears apart, creating a web segment, and whereby said web segment remains adhered to a cutter bar.

2. The apparatus of claim 1, wherein said sharp edge of each said cutter bar comprises a serrated shape.

3. The apparatus of claim 1, wherein an additional feature of each said cutter bar is a predominantly flat surface adjacent to said sharp edge having a surface texture, whereby the adhesion of said web segment is controlled.

4. The apparatus of claim 1, wherein an additional feature of each said cutter bar is a predominantly flat surface adjacent to said sharp edge, whereby a direction of a cantilever portion of the adhered web segment is controlled.

5. The apparatus of claim 1, wherein there is a means to support a roll of web product in a position adjacent to said drum and aligned in direction to said cutter bars, wherein said support means permits the said roll to freely rotate, whereby fresh web product may be peeled and advanced from said roll.

6. The apparatus of claim 1, wherein said means of powering said cutter bars to rotate at different rotational rates and angular positions from one another, comprises a plurality of cam follower rollers which follow a cam path groove, wherein each cam follower roller is mounted on a shaft which is fixed eccentrically to one of a set of meshing gears, wherein another of the gears is connected to an end shaft of each cutter bar, and wherein a shape of the cam path groove is particular to give a desired cutter bar rotation rate and angular position as the drum rotates and as a function of drum rotary position.

7. The apparatus of claim 1, wherein said means of powering said cutter bars to rotate at different rotational rates and angular positions from one another, comprises a plurality of cam follower rollers which follow a cam path groove, wherein each cam follower roller is mounted on a shaft on an end of a lever arm which is connected to and which pivots from an end shaft of each cutter bar, and wherein a shape of the cam path groove is particular to give a desired cutter bar rotation rate and angular position as the drum rotates and as a function of drum rotary position.

8. The apparatus of claim 1, wherein additionally there is a means of adjusting and fixing the radial position of each said cutter bar, whereby the length of said web segment may be preselected.

9. The apparatus of claim 8, wherein said means of adjusting and fixing said radial position of each said cutter bar comprises:

(a) a drum with slotted bearings wherein each said cutter bar is permitted to travel radially, (b) an adjustment disk with a plurality of slotted openings, a longitudinal axis of each slot forming a predominantly spiral shape, wherein each of the cutter bars passes through one of said slotted openings, whereby rotary movement of said adjustment disk controls the radial position of each cutter bar, (c) an adjustment knob, whereby the tightening of said knob fixes a setting of the rotary position of said adjustment disk.

10. The apparatus of claim 9, wherein additionally there is a means of visual indication of said setting.

11. The apparatus of claim 1, wherein said means of powering said cutter bars to rotate at different rotational rates and angular positions from one another, for the purpose of creating a web segment, also comprises a means to transport the adhered web segment to a preferred position and angle.

12. The apparatus of claim 11, wherein there is a means of stopping said drum rotation when said adhered web segment is at said preferred position and angle.

13. The apparatus of claim 12, wherein there is a means of restarting said drum rotation.

14. The apparatus of claim 12, wherein the said means of powering said drum to rotate comprises an electric motor connected to the drum through power transmission means and, wherein said means of stopping said drum rotation comprises a means of interrupting electric power to said electric motor.

15. The apparatus of claim 14, wherein said means of interrupting electrical power comprises an electric switch with a leaf, which at times is activated by one or more lobes of a cam, wherein said cam is fixed to an element of said drum power transmission means, and wherein the number and position of said lobes is particular such that the switch becomes electrically open coincidental with said adhered web attaining said preferred position and angle.

16. The apparatus of claim 15, wherein there is a means of restarting said drum rotation which comprises an act of tangentially moving said web segment from said cutter bar, wherein said act of lifting tangentially moving causes drum rotation, which causes cam rotation, wherein said cam lobe passes out from under said leaf of said switch, wherein the switch is activated to a closed position, wherein said electric power is restored to said electric motor, whereby the drum rotation is restarted.

17. The apparatus of claim 16, wherein there is provided a means of limited rotary freedom in one or more elements of said power transmission means between said electric motor and said cam, whereby said act of tangentially moving said web segment rotates the cam, without restraint from the stationary electric motor, and whereby said means of restarting said drum rotation is enhanced.

18. The apparatus of claim 16, wherein there is a means of creating a loop of surplus web material adjacent to said drum, whereby said act of tangentially moving said web segment rotates said cam, without restraint from a web material drag, and whereby said means of restarting said drum rotation is enhanced.

19. The apparatus of claim 18, wherein said means of creating a loop of surplus web material comprises an idle roller around which said web material passes, wherein said idle roller freely rotates on a shaft, and wherein said shaft is powered by means to translate.

20. The apparatus of claim 19, wherein there is provided a means to inhibit the adhesion of said web material to said idle roller, comprising an idle roller surface and an idle roller finned shape, whereby web product having adhesive on both sides may be cut by said apparatus.

* * * * *